US006891957B2

(12) United States Patent
Manrique et al.

(10) Patent No.: US 6,891,957 B2
(45) Date of Patent: May 10, 2005

(54) VERSATILE SPEAKER BASE

(75) Inventors: Pedro Manrique, Pasadena, CA (US); David Wathen, Los Angeles, CA (US); Eli Harary, Huntington, NY (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 09/949,236

(22) Filed: Sep. 7, 2001

(65) Prior Publication Data

US 2003/0048917 A1 Mar. 13, 2003

(51) Int. Cl.[7] ..... H04R 25/00

(52) U.S. Cl. ..... 381/386; 381/87; 381/395; 181/153

(58) Field of Search ..... 381/87, 302–305, 381/386, 387, 389, 395, 388, 390; 181/148, 150, 153, 199

(56) References Cited

U.S. PATENT DOCUMENTS

| | | | | | |
|---|---|---|---|---|---|
| 4,984,278 | A | * | 1/1991 | Frye et al. | 381/387 |
| 5,416,283 | A | * | 5/1995 | Dault et al. | 181/150 |
| 5,619,585 | A | * | 4/1997 | Grasso | 381/396 |
| 5,859,917 | A | * | 1/1999 | Silber et al. | 381/389 |
| 5,960,095 | A | * | 9/1999 | Chang | 381/386 |
| 6,580,801 | B1 | * | 6/2003 | Takagi et al. | 381/387 |

* cited by examiner

*Primary Examiner*—Suhan Ni
(74) *Attorney, Agent, or Firm*—Squire, Sanders & Dempsey, LLP

(57) ABSTRACT

This invention is directed a combination of a speaker base and a mounting bracket that secures a speaker enclosure to either a horizontal surface or a vertical surface. The mounting bracket may be adapted to couple to a wall and releasably to the speaker base. The speaker base may be adapted to pivotally couple to the speaker enclosure so depending on whether the speaker base is mounted onto wall or table, the speaker enclosure may be pivoted into a desired position.

7 Claims, 5 Drawing Sheets

VERSATILE SPEAKER BASE

BACKGROUND OF THE INVENTION

1. Field of the Invention

This invention relates to a speaker base that couples to a wall using a mounting bracket and conceals speaker wires 2. Related Art A typical surround audio speaker system has front speakers, a subwoofer, and rear speakers to produce surround sound. In order to maximize the performance of each speaker, it is important to survey the room, and position all of the speakers properly to optimize the performance of the speakers. The optimal location for some speakers, especially the rear speakers, may be to mount them to a wall. Mounting speakers to a wall, however, can take great effort and may not be aesthetically pleasing. Many wall-mounted speakers require two people to install the speaker to a wall. One person typically holds the speaker to a wall, while the other person secures the speaker to the wall with screws. Alternatively, a mounting bracket may be secured to a wall and then the speaker is attached to the mounting bracket. Such installations, are also time-consuming and may be aesthetically displeasing because screws and speaker wires remain visible.

Unlike rear speakers, the front speakers may be placed on top of a table or on a shelf. To do so, the base of the speaker enclosure needs to be flat in order to sit on top of the table. Otherwise, a separate stand or mounting base may be needed in order to hold the speaker in an upright position on top of a table. This means that two separate mounting systems are needed to mount the speaker onto a wall and table. This adds to the complexity and cost of installing the speaker to a room. Therefore, there still is a need for a way to secure a speaker onto wall cost effectively, easily, and aesthetically pleasing.

SUMMARY

This invention provides a speaker base combined with a mounting bracket securing the speaker enclosure to different surfaces such as horizontal and vertical surfaces. The speaker base may be between the mounting bracket and the speaker enclosure. The mounting bracket may be adapted to couple to a wall and releasably to the speaker base. The speaker base may be adapted to pivotally couple to the speaker enclosure so depending on whether the speaker base is mounted onto wall or table, the speaker enclosure may be pivoted into a correct position.

The above combination may be secured to a wall in as few as three steps. First, a mounting bracket may be held at a predetermined position along a wall and secured to the wall. Second, the speaker base may be coupled to the mounting bracket to in effect secure the speaker base to the wall. Third, the speaker enclosure may be coupled to the speaker base to mount the speaker enclosure to the wall at the predetermined position. Then, the speaker enclosure may be pivoted relative to the speaker base so that the face of the speaker enclosure is facing the right location to optimize the performance of the speaker.

To place the speaker enclosure on top of a horizontal surface such as a table, the speaker base may be adapted to hold the speaker enclosure in an upright position. This way, the same speaker base may be used to mount the speaker onto a wall or a table. The speaker base may have wire openings that conceal wires that connect to the terminals on the backside of the speaker enclosure. This way, the wires fall straight from their respective terminals and into the speaker base that leads them to a receiver or an amplifier without being seen. By substantially hiding the wires, the invention provides an aesthetically pleasing appearance to the speaker enclosure.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
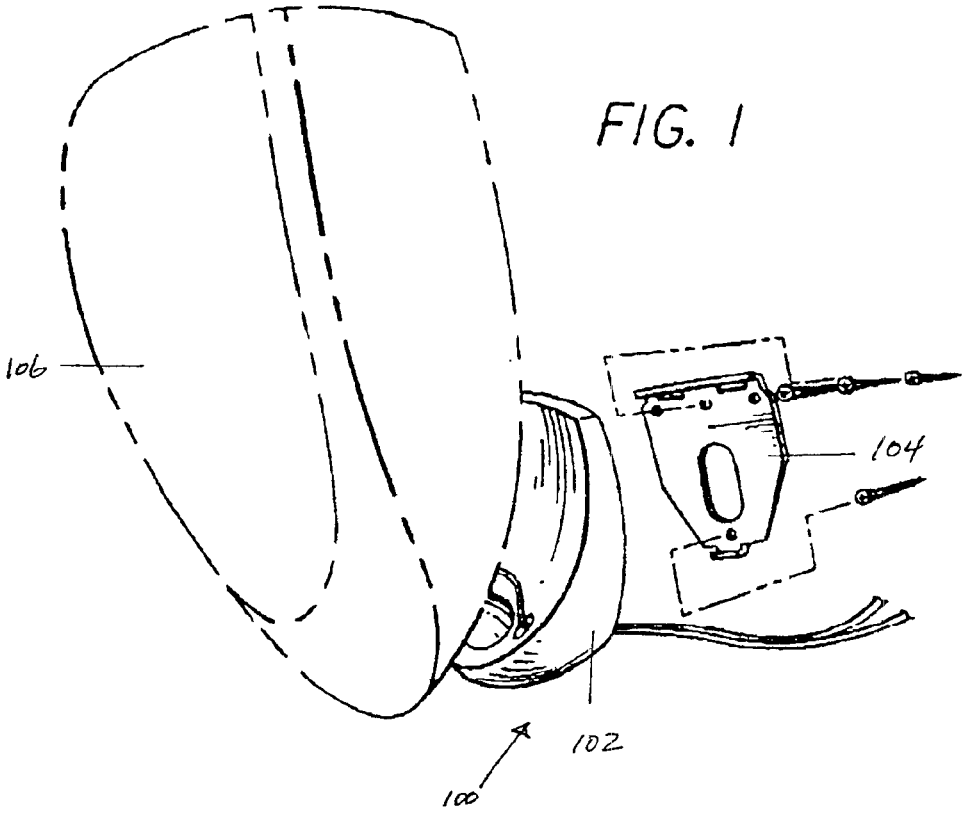
FIG. 1 is a perspective view of a speaker installation system.
Figure 2:
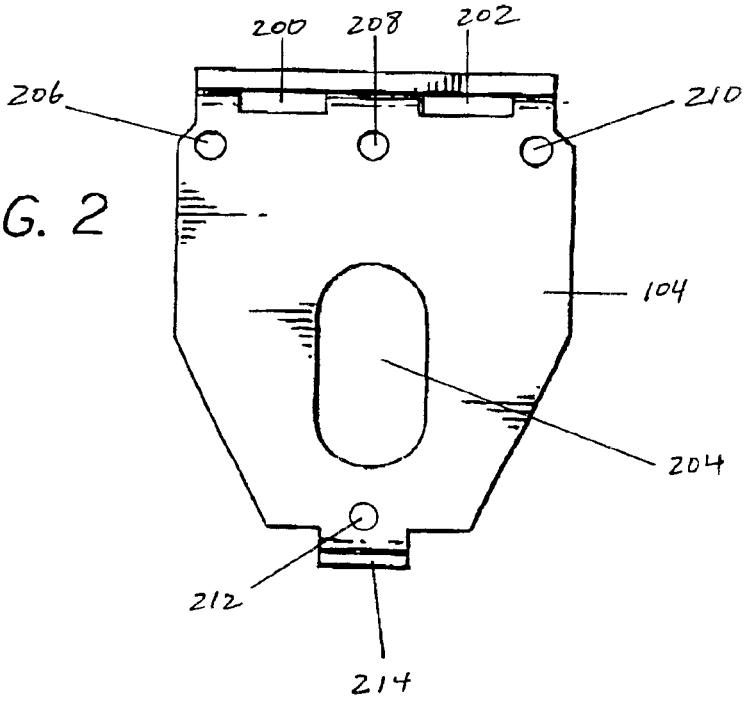
FIG. 2 is a front view of the mounting bracket in FIG. 1.

FIGS. 1 and 2 illustrate a speaker installation system 100 having a speaker base 102 adapted to couple to a mounting bracket 104. The speaker base 102 may release from the mounting bracket before and after the two are coupled together. The mounting bracket 104 may be held to a wall at a predetermined position that may be optimal for the speaker enclosure 106. Then the mounting bracket 104 may be secured to the wall using screws through holes 206, 208, 210, and 212, for example. Besides using screws, other methods known to one skilled in the art may be used to secure the mounting bracket 104 to the wall.

If the wires for the speaker have been pre-wired into a wall, the mounting bracket 104 may have a large opening 204 so that wires may run through the opening 204 to provide power to the speakers or drivers in the speaker enclosure 106. Moreover, the mounting bracket 104 may have two slots 200 and 202 adapted to receive a pair of teeth from the speaker base 102 to couple the two together as discussed in more detail below. The mounting bracket 104 may also have a flange 214 that may be perpendicular to the mounting plate 104 to securely hold the mounting plate 104 within the speaker base 102. By installing a mounting bracket 104 to a wall first without the speaker enclosure 106, the weight of the speaker enclosure 106 does not get in the way of the installation so that one person may easily install the mounting bracket 104.

Figure 3:
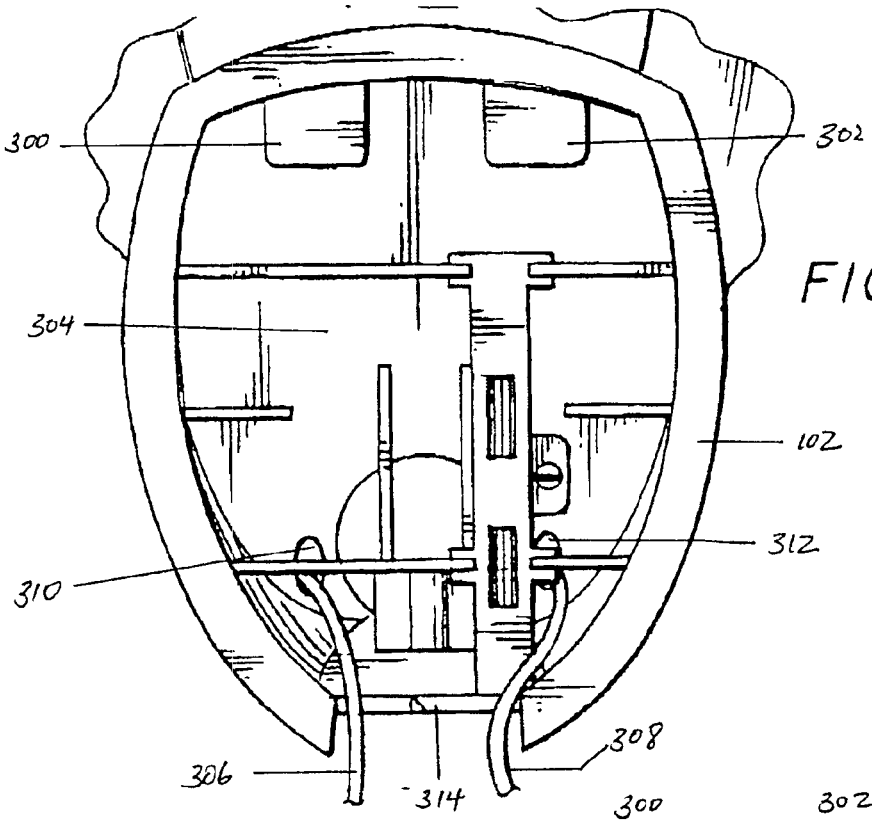
FIG. 3 is a bottom view of the speaker base in FIG. 1.

FIG. 3 illustrates the bottom view of the speaker base 102 having a recess bore 304 adapted to receive the mounting bracket 104. This way, the mounting bracket 104 may be flush within the speaker base 102 so that the mounting bracket 104 does not show for aesthetic reasons. To couple the mounting base 104 to the speaker base 102, the speaker base 102 may have a pair of teeth 300 and 302 sized to associate with the two slots 202 and 200, respectively. On the opposing end, a retainer wall 314 may be provided to mate with the flange 214 from the mounting bracket 104 to hold the mounting bracket 104 within the recess bore 304. Wire openings 310 and 312 may be formed within the speaker base 102 to receive the wires 306 and 308 to provide power to the drivers in the speaker enclosure 106.

Figure 4:
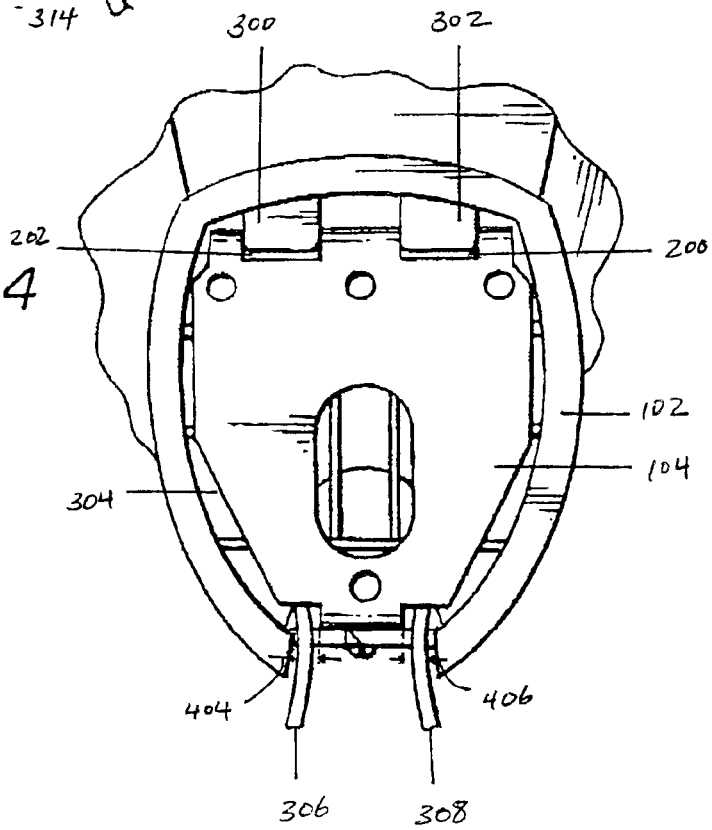
FIG. 4 is a bottom view of the speaker base in association with the mounting bracket.
Figure 5:
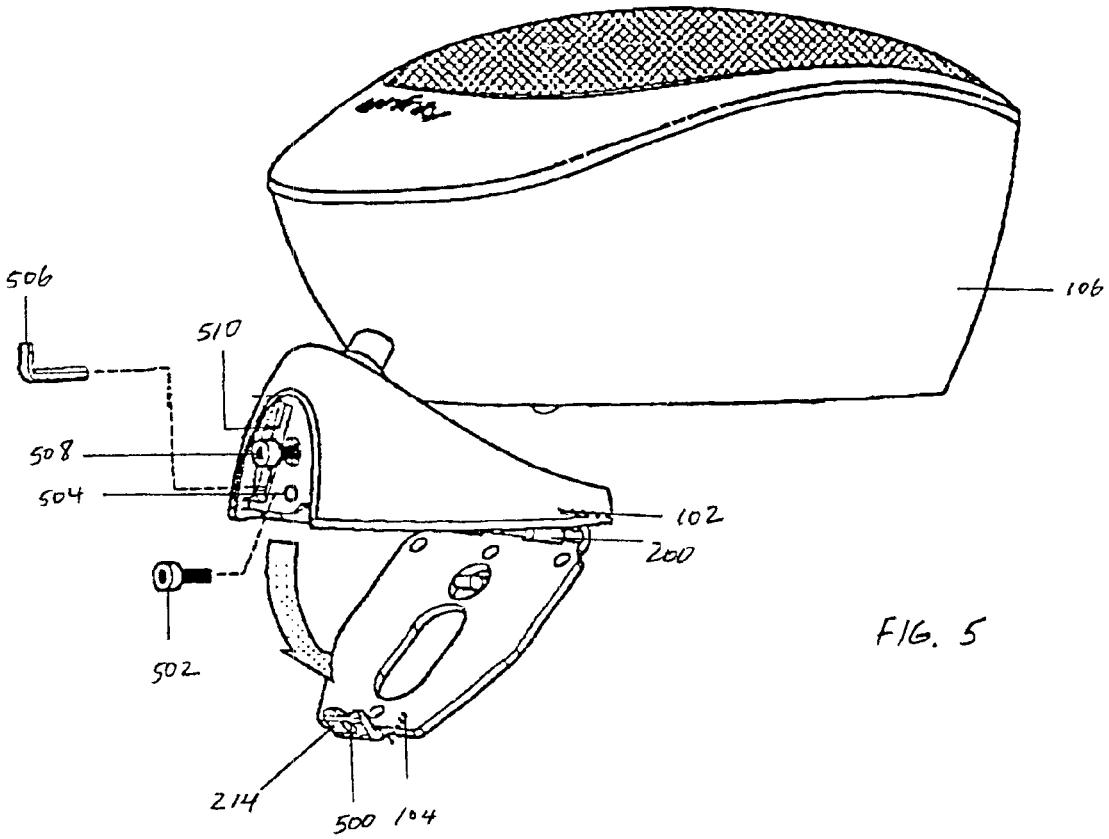
FIG. 5 is a perspective view of the speaker base coupled to a speaker enclosure.

FIG. 4 illustrates the mounting bracket 104 flush within the speaker base 102 and held in place by the pair of teeth 300 and 302 mating with the slots 202 and 200, respectively. The flange 214 may make a contact with the retainer wall 314 so that friction between the two holds mounting bracket 104 within the speaker base 102. As illustrated in FIG. 5, this may be done by sliding the speaker base 102 over the mounting bracket 104 until the pair of teeth 300, 302 make contact with the two corresponding slots 202, 200. Then the speaker base 102 and the mounting bracket 104 may be pushed together until the flange 214 is adjacent to the retainer wall 314. Besides friction, the flange 214 may be configured to snap together with the retainer wall 314. The wires 306 and 308 may run through the gaps 404 and 406, respectively, between the mounting bracket 104 and the speaker base 102.

Alternatively, FIG. 5 illustrates a screw 502 adapted to couple the mounting bracket 104 to the speaker base 10. The flange 214 may have a threaded opening 500 adapted to receive the screw 500. The speaker base 102 may have a screw hole 504 adapted to receive the screw 502 and aligned with the threaded opening 500. This way, the screw 502 may be inserted into the screw hole 504 and into the threaded opening 500. For convenience, a wrench 506 may be provided within the speaker base 102, which can be used to tighten the screw 502. When the wrench is not in use, it may be stowed within the cavity 510 within the speaker base 102. Once the speaker base 102 is coupled to the mounting bracket 104, the speaker enclosure 106 may be coupled to the speaker base 102 using a socket and cup restraining system as discussed in more detail below. FIG. 5 illustrates the speaker enclosure 106 in a wall mounting position relative to the mounting base 102.

Figure 6:
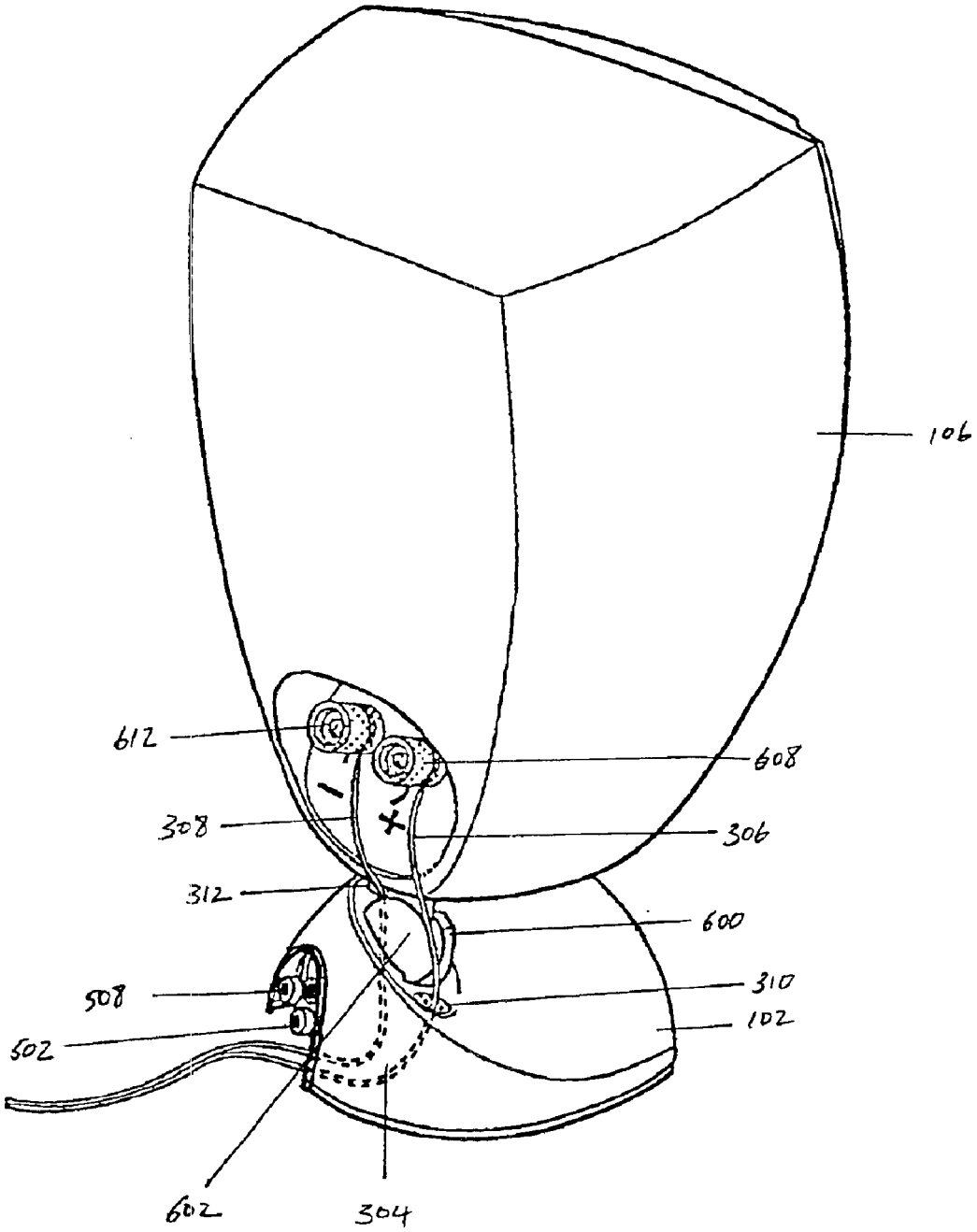
FIG. 6 is a perspective rear view of a speaker enclosure coupled to a speaker base in an upright position.

FIG. 6 illustrates the speaker enclosure 106 coupled to the speaker base 102 in an upright position. In this position, the speaker base 102 may be sitting onto top of a horizontal table or bookshelf. To couple the speaker enclosure 106 to the speaker base 102, the speaker base 102 may have a cup restraint 600 adapted to receive a socket 602 extending from the speaker enclosure 106. The socket 602 may be shaped like a ball so that the speaker enclosure 106 may pivot about the cup restraint 600. Once the speaker enclosure 106 is in a desired position, it may be held in that position by adjusting the screw 508 to tighten the cup restraint 600 against the socket 602 to hold the speaker enclosure 106 in its place. The wrench 506 may also be used to tighten the adjustment screw 508.

To place the speaker enclosure 106 on top of a table, the mounting bracket 104 need not be secured to the table. In other words, the mounting bracket 104 may be optional when placing the speaker enclosure 106 on top of a table. Rather, the weight of the speaker enclosure 106, including the drivers, may be such that it is sufficient to stabilize the speaker enclosure 106 on top of the table. When the speaker enclosure 16 is in a substantially upright position, the center of gravity of the speaker enclosure 106 may be aligned with the socket 602 to prevent the speaker enclosure 16 from tilting over about the socket 602. To hide the wires, the wires 306 and 308 may run through the bottom side of the speaker base 102 and up through the wire openings 310 and 312 and terminate on its respective terminals 608 and 612.

Figure 7:
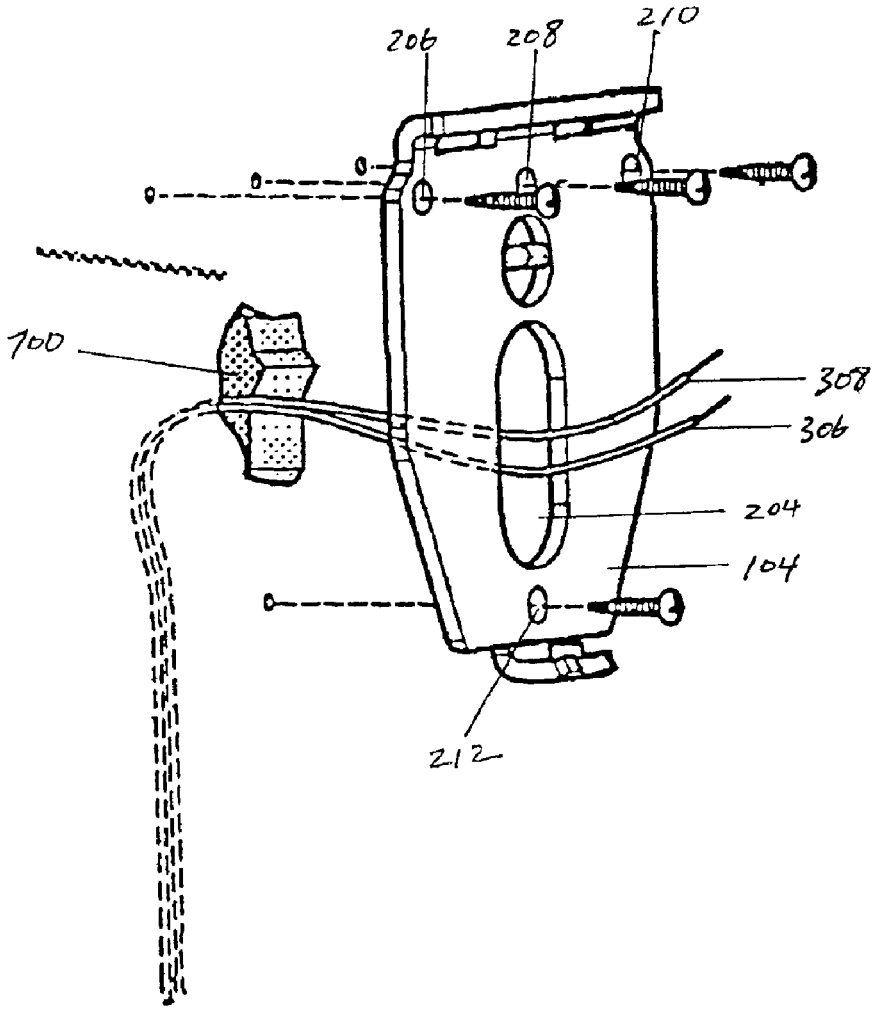
FIG. 7 is a perspective view of the mounting bracket in FIG. 1.

FIG. 7 illustrates running the wires through the opening 204 in the mounting bracket 104 in situations where a wall has been pre-wired. After the optimal spot for placement of a speaker is located on a wall, an opening 700 may be created within the wall substantially near where the mounting bracket is to be secured. The mounting bracket 104 is then secured on the wall as discussed above. The wires 306 and 308 are then run through the wire openings on the speaker base to its respective terminals. This way, the wires 306 and 308 are substantially concealed within the speaker base 102 and behind the wall.

The same speaker base 102 may be used to mount the speaker enclosure 106 on a wall or table. Installing the speaker enclosure is more easily done by first securing the mounting bracket 104, which is much easier than trying to install a heavier speaker enclosure first. Then to optimize the performance, the speaker enclosure may be pivoted relative to the speaker base so that sound from the speaker enclosure emanate to a listening area. For convenience, tools necessary to couple the speaker base to the mounting base and to adjust the positioning of the speaker enclosure relative to the speaker base may be housed within the speaker base.

While various embodiments of the application have been described, it will be apparent to those of ordinary skill in the art that many more embodiments and implementations are possible within the scope of this invention. Accordingly, the invention is not to be restricted except in light of the attached claims and their equivalents.

What is claimed is:

1. A speaker installation system, comprising:

a mounting bracket having a slot and adapted to couple to a wall where the mounting bracket has a flange on an opposing end of the slot; and a speaker base having a recess bore adapted to receive the mounting bracket and a tooth adapted to associate with the slot on the mounting bracket, the speaker base having a cup adapted to receive a socket extending from a speaker enclosure to pivotally couple the speaker enclosure to the speaker base, and the speaker base having a retainer wall adapted to associate with the flange on the mounting bracket.

2. The system according to claim 1, further including a screw to couple the flange to the retainer wall.

3. The system according to claim 1, wherein the speaker base has a wire opening to run a wire therethrough to power a driver housed in a speaker enclosure.

4. The system according to claim 1, wherein the speaker base is adapted to placed on top of a substantially horizontal surface.

5. A speaker installation system, comprising:

a mounting bracket adapted to couple to a surface; and a speaker base between a speaker enclosure and the mounting bracket where the speaker enclosure is adapted to pivotally couple to the speaker base, the mounting bracket has a pair of slots, the speaker base has a pair of teeth adapted associated with the pair of slots to couple the speaker base to the mounting bracket, the speaker base has a retaining wall, and the mounting bracket has a flange adapted to frictionally contact the retaining wall to couple the speaker base to the mounting bracket.

6. The system according to claim 5, further including a screw through the flange and the retaining wall to couple the speaker base to the mounting bracket.

7. The system according to claim 5, wherein the speaker base has a wire opening adapted to receive a wire to provide power to a driver in the speaker enclosure.

* * * * *